US009242340B1

(12) United States Patent
Moravec et al.

(10) Patent No.: US 9,242,340 B1
(45) Date of Patent: Jan. 26, 2016

(54) METHOD TO STRESS RELIEVE A MAGNETIC RECORDING HEAD TRANSDUCER UTILIZING ULTRASONIC CAVITATION

(71) Applicant: Western Digital Technologies, Inc., Irvine, CA (US)

(72) Inventors: Mark D. Moravec, Lamlukka (TH); Phanphat Taechangam, Yannawa (TH); Alan H. Brothers, Amphur Mueang (TH)

(73) Assignee: Western Digital Technologies, Inc., Irvine, CA (US)

( * ) Notice: Subject to any disclaimer, the term of this patent is extended or adjusted under 35 U.S.C. 154(b) by 249 days.

(21) Appl. No.: 13/797,746

(22) Filed: Mar. 12, 2013

(51) Int. Cl.
*B24B 31/06* (2006.01)
*B24B 37/04* (2012.01)
*B29C 71/04* (2006.01)

(52) U.S. Cl.
CPC ..... *B24B 37/048* (2013.01); *B29C 71/04* (2013.01)

(58) Field of Classification Search
CPC ..... B24B 31/06; B24B 31/064
USPC ..... 451/54, 36, 104, 113
See application file for complete search history.

(56) References Cited

U.S. PATENT DOCUMENTS 2,591,083 A * 4/1952 Maier ..... 451/36
3,535,159 A * 10/1970 Shiro ..... 134/1
5,117,589 A 6/1992 Bischoff et al.
5,268,207 A * 12/1993 Kruger et al. ..... 427/560
5,335,458 A 8/1994 Stoffers et al.
5,384,989 A * 1/1995 Shibano ..... 451/36
5,516,323 A 5/1996 Carlson et al.
5,607,340 A 3/1997 Lackey et al.
5,718,035 A 2/1998 Yamanaka et al.
5,739,048 A 4/1998 Kerth et al.
5,745,983 A 5/1998 Quintana et al.
5,820,688 A * 10/1998 Koppl et al. ..... 134/2
5,987,725 A 11/1999 Church et al.
6,075,673 A 6/2000 Wilde et al.
6,093,083 A 7/2000 Lackey
6,097,575 A 8/2000 Trang et al.
6,125,014 A 9/2000 Riedlin, Jr.
6,125,015 A 9/2000 Carlson et al.
6,130,863 A 10/2000 Wang et al.
6,137,656 A 10/2000 Levi et al.

(Continued)

OTHER PUBLICATIONS http://en.wikipedia.org/wiki/Ultrasonic_impact_treatment, Ultrasonic Impact Treatment. Downloaded Oct. 18, 2012.
Mark D. Moravec , et al. U.S. Appl. No. 13/537,018, filed Jun. 28, 2012, 17 pages.
Mark D. Moravec, et al. U.S. Appl. No. 13/333/608, filed Dec. 21, 2011, 17 pages.
Mark D. Moravec, et al. U.S. Appl. No. 12/617,569, filed Nov. 12, 2009, 24 pages.

*Primary Examiner* — Robert Rose

(57) ABSTRACT

Magnetic heads are fabricated by slicing and dicing wafers into row bars, which undergo frontside lapping and backside lapping. These lapping processes, as well as other processes, induce stresses on the row bars that are released prior to finalizing the magnetic head. Ultrasonic impact technology is used to release the stress in the row bars and to clean the row bars at the same time. Ultrasonic impact technology is used after the row bars have been wire bonded without having to de-bond the row bars.

15 Claims, 8 Drawing Sheets

(56) References Cited

U.S. PATENT DOCUMENTS 6,144,528 A 11/2000 Anaya-Dufresne et al.
6,147,838 A 11/2000 Chang et al.
6,151,196 A 11/2000 Carlson et al.
6,162,114 A 12/2000 Kobayashi et al.
6,178,064 B1 1/2001 Chang et al.
6,181,522 B1 1/2001 Carlson
6,181,673 B1 1/2001 Wilde et al.
6,202,289 B1 3/2001 Yoshimura et al.
6,229,672 B1 5/2001 Lee et al.
6,236,543 B1 5/2001 Han et al.
6,246,547 B1 6/2001 Bozorgi et al.
6,249,404 B1 6/2001 Doundakov et al.
6,257,959 B1 7/2001 Kobayashi et al.
6,261,165 B1 7/2001 Lackey et al.
6,312,313 B1 11/2001 Gee et al.
6,315,636 B1 11/2001 Yanagida et al.
6,330,131 B1 12/2001 Nepela et al.
6,339,518 B1 1/2002 Chang et al.
6,349,017 B1 2/2002 Schott
6,354,912 B1 3/2002 Osada et al.
6,373,660 B1 4/2002 Lam et al.
6,378,195 B1 4/2002 Carlson
6,398,623 B1 6/2002 Fukuroi et al.
6,433,460 B1 * 8/2002 Puskas ..... 310/317
6,443,813 B1 9/2002 Strom et al.
6,522,504 B1 2/2003 Casey
6,531,084 B1 3/2003 Strom et al.
6,538,850 B1 3/2003 Hadian et al.
6,546,355 B2 4/2003 Matsushita
6,551,438 B1 4/2003 Tanemura
6,583,953 B1 6/2003 Han et al.
6,604,989 B2 8/2003 Yanagida et al.
6,646,832 B2 11/2003 Anaya-Dufresne et al.
6,661,612 B1 12/2003 Peng
6,662,069 B1 12/2003 Khlif
6,663,817 B1 12/2003 Chang et al.
6,665,146 B2 12/2003 Hawwa et al.
6,687,976 B1 2/2004 Koyama et al.
6,690,545 B1 2/2004 Chang et al.
6,704,173 B1 3/2004 Lam et al.
6,708,389 B1 3/2004 Carlson et al.
6,717,773 B2 4/2004 Hawwa et al.
6,721,142 B1 4/2004 Meyer et al.
6,722,947 B2 4/2004 Nishioka et al.
6,733,377 B2 5/2004 Adachi et al.
6,744,599 B1 6/2004 Peng et al.
6,771,468 B1 8/2004 Levi et al.
6,796,018 B1 9/2004 Thornton
6,801,402 B1 10/2004 Subrahmanyam et al.
6,802,115 B2 10/2004 Shiraishi et al.
6,802,761 B1 10/2004 Beaucage et al.
6,843,705 B2 1/2005 Boutaghou
6,856,489 B2 2/2005 Hawwa et al.
6,873,496 B1 3/2005 Sun et al.
6,912,103 B1 6/2005 Peng et al.
6,913,509 B2 7/2005 Sone et al.
6,916,227 B2 7/2005 Mahadev et al.
6,926,582 B2 8/2005 Beckle et al.
6,937,439 B1 8/2005 Chang et al.
6,942,544 B2 9/2005 Beaucage et al.
6,956,718 B1 10/2005 Kulkarni et al.
6,960,117 B1 11/2005 Mahadev et al.
6,972,930 B1 12/2005 Tang et al.
6,976,302 B2 12/2005 Itoh et al.
6,994,608 B1 2/2006 Tzeng et al.
7,006,330 B1 2/2006 Subrahmanyam et al.
7,006,331 B1 2/2006 Subrahmanyam et al.
7,010,847 B1 3/2006 Hadian et al.
7,014,532 B2 3/2006 Nishioka et al.
7,019,945 B1 3/2006 Peng et al.
7,027,264 B1 4/2006 Subrahmanyam et al.
7,049,809 B2 5/2006 Luo et al.
7,085,104 B1 8/2006 Hadian et al.
7,099,117 B1 8/2006 Subrahmanyam et al.
7,124,497 B1 10/2006 Olim et al.
7,165,462 B2 1/2007 Luo et al.
7,174,622 B2 2/2007 Meyer et al.
7,189,150 B2 3/2007 Zhan et al.
7,258,151 B2 8/2007 Nomura et al.
7,289,299 B1 10/2007 Sun et al.
7,307,816 B1 12/2007 Thornton et al.
7,315,435 B1 1/2008 Pan
7,315,436 B1 1/2008 Sanchez
7,414,814 B1 8/2008 Pan
7,436,631 B1 10/2008 Fanslau, Jr. et al.
7,467,460 B2 12/2008 Tan et al.
7,474,508 B1 1/2009 Li et al.
7,477,486 B1 1/2009 Sun et al.
7,562,435 B2 7/2009 Mahadev et al.
7,593,190 B1 9/2009 Thornton et al.
7,595,963 B1 9/2009 Chen et al.
7,616,405 B2 11/2009 Hu et al.
7,716,811 B2 5/2010 Seki et al.
7,729,089 B1 6/2010 Hogan
7,995,310 B1 8/2011 Pan
8,081,400 B1 12/2011 Hu
8,087,973 B1 1/2012 Sladek et al.
8,089,730 B1 1/2012 Pan et al.
8,164,858 B1 4/2012 Moravec et al.
8,199,437 B1 6/2012 Sun et al.
8,208,224 B1 6/2012 Teo et al.
8,218,268 B1 7/2012 Pan
8,240,545 B1 8/2012 Wang et al.
8,256,272 B1 9/2012 Roajanasiri et al.
8,295,012 B1 10/2012 Tian et al.
8,295,013 B1 10/2012 Pan et al.
8,295,014 B1 10/2012 Teo et al.
8,320,084 B1 11/2012 Shum et al.
8,325,446 B1 12/2012 Liu et al.
8,325,447 B1 12/2012 Pan
8,339,742 B1 12/2012 Sladek et al.
8,339,747 B1 12/2012 Hales et al.
8,339,748 B2 12/2012 Shum et al.
8,343,363 B1 1/2013 Pakpum et al.
8,345,519 B1 1/2013 Pan
8,418,353 B1 4/2013 Moravec et al.
8,441,896 B2 5/2013 Wang et al.
8,446,694 B1 5/2013 Tian et al.
8,456,643 B2 6/2013 Prabhakaran et al.
8,456,776 B1 6/2013 Pan
8,462,462 B1 6/2013 Moravec et al.
8,477,459 B1 7/2013 Pan
8,485,579 B2 7/2013 Roajanasiri et al.
8,488,279 B1 7/2013 Pan et al.
8,488,281 B1 7/2013 Pan
8,490,211 B1 7/2013 Leary
8,514,522 B1 8/2013 Pan et al.
8,533,936 B1 9/2013 Puttichaem et al.
8,545,164 B2 10/2013 Choumwong et al.
8,553,365 B1 10/2013 Shapiro et al.
8,587,901 B1 11/2013 Puttichaem et al.
8,593,764 B1 11/2013 Tian et al.
8,599,653 B1 12/2013 Mallary et al.
8,605,389 B1 12/2013 Pan et al.
8,611,050 B1 12/2013 Moravec et al.
8,611,052 B1 12/2013 Pan et al.
8,623,197 B1 1/2014 Kobsiriphat et al.
8,624,184 B1 1/2014 Souza et al.
8,665,566 B1 3/2014 Pan et al.
8,665,567 B2 3/2014 Shum et al.
8,665,677 B1 3/2014 Panitchakan et al.
8,665,690 B1 3/2014 Moravec et al.
8,693,144 B1 4/2014 Pan et al.
8,756,795 B1 6/2014 Moravec et al.
8,758,083 B1 6/2014 Rudy et al.
8,760,812 B1 6/2014 Chen et al.
8,770,463 B1 7/2014 Puttichaem et al.
8,773,664 B1 7/2014 Wang et al.
8,792,212 B1 7/2014 Pan et al.
8,792,213 B1 7/2014 Vijay et al.
2003/0005573 A1 1/2003 Shiraishi et al.
2003/0056628 A1 3/2003 Razon
2005/0007699 A1 1/2005 Ohno et al.
2006/0027542 A1 2/2006 Mahadev et al.

(56) References Cited

U.S. PATENT DOCUMENTS

2006/0265863 A1 11/2006 Murakoshi
2007/0119046 A1 5/2007 Seki et al.
2013/0244541 A1 9/2013 Yaemglin et al.
2013/0293982 A1 11/2013 Huber

* cited by examiner

METHOD TO STRESS RELIEVE A MAGNETIC RECORDING HEAD TRANSDUCER UTILIZING ULTRASONIC CAVITATION

FIELD

The present disclosure relates generally to reducing stress in work pieces using ultrasonic cavitation, and more particularly, to reducing stress in magnetic heads, which are incorporated into hard drives, using ultrasonic cavitation during fabrication of the magnetic heads.

BACKGROUND

Magnetic disk drives are used to store and retrieve data in many electronic devices including computers, televisions, video recorders, servers, digital recorders, etc. A typical magnetic disk drive includes a head having a slider and a transducer with a read and write element that is in very close proximity to a surface of a rotatable magnetic disk. As the magnetic disk rotates beneath the head, a thin air bearing is formed between the surface of the magnetic disk and an air bearing surface (ABS) of the slider. The read and write elements of the head are alternatively used to read and write data while a suspension assembly positions the head along magnetic tracks on the magnetic disk. The magnetic tracks on the magnetic disks are typically concentric circular regions on the magnetic disks, onto which data can be stored by writing to it and retrieved by reading from it.

The slider is aerodynamically designed to fly above a rotating magnetic disk by virtue of an air bearing created between the ABS of the slider and the rotating magnetic disk. The ABS is the portion of the slider surface which is closest to the rotating magnetic disk, which is typically the head portion of the slider. In order to maximize the efficiency of the head, the sensing elements (i.e., the read and write heads) are designed to have precise dimensional relationships to each other. In addition, the distance between the ABS and the rotating magnetic disk is tightly controlled. The dimension that relates to the write function is known as the throat height and the dimension that relates to the read function is known as the stripe height. Both the stripe height and the throat height are controlled by lapping processes.

Multiple lapping processes are performed on row bars, which are rows of sliders/heads, and include backside lapping followed by frontside lapping. During the lapping process, row bars are mounted on a separate lapping tool at each lapping operation using an adhesive, tape and/or separate double-sided adhesive film. The lapping process alters and removes materials, as well as polishes, the row bars, which creates stresses on and within the surfaces of the row bars that are lapped. If these stresses are not released and are left in the finished magnetic head, which is made from a row bar, the stresses can cause the finished magnetic head to be damaged later. Therefore, these stresses are released and corrected during the manufacturing process. The damage occurs because magnetic heads which are stressed are also unstable and can change their shape later after they have been installed in a hard drive. The magnetic head's shape changes because of instability, which results from stress built up. When this change occurs it is referred to as "POPPING" because the change is a permanent over coat protrusion (POP) that occurs on the surface of the head and resembles the magnetic head surface popping up. Therefore, as part of the manufacturing process, the stress built up in the head, which is a result of processes like lapping, is released in order to stabilize the head and avoid "POPPING" later.

Conventional methods of releasing these stresses involve annealing the head at high temperatures to induce the "POPPING" to occur and therefore remove the instability from the magnetic head. The conventional high temperature annealing process, which is used to relieve stresses, is optimally performed just prior to the final lapping operation and after the rough lapping operation. However, using high temperature annealing on row bars of magnetic heads, after rough lapping, requires the row bars to be de-bonded from a lapping row tool because high temperature annealing can destroy the adhesive and mounted wire bond board. These steps of bonding and de-bonding wires to row bars require significant extra processing steps that are expensive.

Therefore, what is needed is a system and method that releases stresses built up in row bars as a result of fabrication processes, such as lapping, as well as reduces the number of times that wires are bonded and de-bonded to row bars and thus lowers magnetic head fabrication costs.

SUMMARY

Several aspects of the present invention will be described more fully hereinafter with reference to various embodiments of methods and apparatuses related to reducing stress in semiconductor work pieces as the semiconductor work pieces are being fabricated. The stresses are a result of manufacturing processes used to fabricate the semiconductor work pieces.

One aspect of a method used to release stress in a work piece includes providing a work piece with a stressed layer formed in the work piece and releasing stress built up in the stressed layer by immersing the work piece with the stressed layer into a bath of liquid and subjecting the work piece and the stressed layer to ultrasonic waves generated in the liquid.

Another aspect of a method is used to release stresses in a magnetic head as the magnetic head is being fabricated. The stresses are a result of the manufacturing processes used to fabricate the magnetic head. The aspect of the method includes providing a substrate with at least one layer, rough lapping the substrate with the at least one layer to produce a substrate having at least one stressed layer, and treating the substrate and the stressed layer with ultrasonic waves to release stress built up after the substrate and the at least one layer have undergone rough lapping.

Another aspect of a method used to release stress in a work piece includes a step for providing a work piece with a stressed region formed in the work piece and a step for releasing stress built up in the stressed region of the work piece by subjecting the work piece to ultrasonic waves.

It will be understood that other aspects of the present invention will become readily apparent to those skilled in the art from the following disclosure, wherein it is shown and described only several embodiments of the invention by way of illustration. As will be realized by those skilled in the art, the present invention is capable of other and different embodiments and its several details are capable of modification in various other respects, all without departing from the spirit and scope of the invention. Accordingly, the drawings and detailed description are to be regarded as illustrative in nature and not as restrictive.

BRIEF DESCRIPTION OF THE DRAWINGS

Various aspects of the present invention will now be presented in the detailed description by way of example, and not by way of limitation, with reference to the accompanying drawings, wherein.

DETAILED DESCRIPTION

Figure 1:
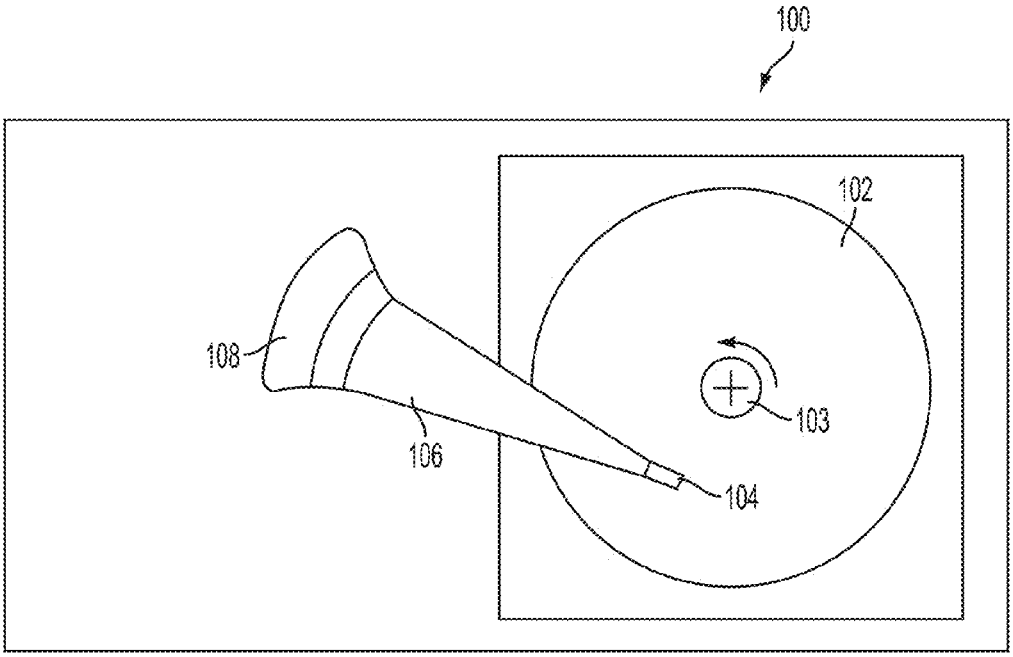
FIG. 1 is a conceptual view of an exemplary embodiment of a magnetic disk drive that incorporates a magnetic head and slider.

The detailed description is intended to provide a description of various exemplary embodiments of the present invention and is not intended to represent the only embodiments in which the invention may be practiced. The term "exemplary" used throughout this disclosure means "serving as an example, instance, or illustration," and should not necessarily be construed as preferred or advantageous over other embodiments. The detailed description includes specific details for the purpose of providing a thorough and complete disclosure that fully conveys the scope of the invention to those skilled in the art. However, the invention may be practiced without these specific details. In some instances, well-known structures and components may be shown in block diagram form, or omitted entirely, in order to avoid obscuring the various concepts presented throughout this disclosure.

Various aspects of the present invention may be described with reference to certain shapes and geometries. Any reference to a component having a particular shape or geometry, however, should not be construed as limited to the precise shape illustrated or described, but shall include deviations that result, for example, from manufacturing techniques and/or tolerances. By way of example, a component, or any part of a component, may be illustrated or described as rectangular, but in practice may have rounded or curved features due to manufacturing techniques and/or tolerances. Accordingly, the components illustrated in the drawings are schematic in nature and their shapes are not intended to illustrate the precise shape of the component, and therefore, not intended to limit the scope of the present invention.

In the following detailed description, various aspects of the present invention will be presented in the context of releasing stress in row bars during the fabrication of magnetic heads used in magnetic disk drives. While these inventive aspects may be well suited for this application, those skilled in the art will realize that such aspects may be extended to other applications. Accordingly, any reference to apparatuses and methods related to releasing stress in row bars during magnetic head fabrication processes, which are used in magnetic disk drives, is intended only to illustrate the various aspects of the present invention, with the understanding that such aspects may have a wide range of applications.

FIG. 1 is a conceptual view of an exemplary magnetic disk drive. The magnetic disk drive 100 is shown with a rotatable magnetic disk 102. The magnetic disk 102 may be rotated on a spindle 103 by a disk drive motor (not shown) located under the magnetic disk 102. A head 104, which can be a perpendicular magnetic recording (PMR) head or lateral magnetic recording (LMR) head, may be used to read and write information by detecting and modifying the magnetic polarization of the recording layer on the disk's surface. The head 104 is generally integrally formed with a carrier or slider (not shown). The function of the slider is to support the head 104 and any electrical connections between the head 104 and the rest of the magnetic disk drive 100. The slider is mounted to a positioner arm 106 which may be used to move the head 104 on an arc across the rotating magnetic disk 102, thereby allowing the head 104 to access the entire surface of the magnetic disk 102. The positioner arm 106 comprises a head gimbal assembly (HGA), which includes a load beam and a gimbal disposed on the end of the load beam, and an actuator unit 108. The positioner arm 106 may be moved using a voice coil actuator, which is part of the actuator 108, or by some other suitable means.

The slider is aerodynamically designed to fly above the magnetic disk 102 by virtue of an air bearing created between the surface of the slider and the rotating magnetic disk 102. This surface of the slider is referred to as an air bearing surface (ABS). The ABS is the portion of the slider surface which is closest to the rotating magnetic disk 102, which is typically the head 104. In order to maximize the efficiency of the head 104, the sensing elements (i.e., the read and write heads) are designed to have precise dimensional relationships to each other. In addition, the distance between the ABS and the rotating magnetic disk 102 is tightly controlled. The dimension that relates to the write function is known as the throat height and the dimension that relates to the read function is known as the stripe height. Both the stripe height and the throat height are controlled by lapping processes.

Lapping processes that are used for lapping row bars during the fabrication of magnetic heads, which are used in magnetic disk drives, can induce stresses in the heads which can cause the head to be damaged later unless corrected during the manufacturing process. The damage can occur because stressed magnetic heads are unstable and their shape can change after a finished magnetic head is installed in a hard drive. The magnetic head's shape can change because of instability, which results from stress built up. When this change occurs it is referred to as "POPPING" because the change is a permanent over coat protrusion (POP) that occurs on the surface of the head and resembles the magnetic head surface popping up. Therefore, as part of the manufacturing process, the stress built up in the head, which is a result of processes like lapping, is released in order to stabilize the head and avoid "POPPING" later.

Conventional methods of releasing these stresses involve annealing a magnetic head to induce "POPPING" and therefore remove the instability from the magnetic head. Further, since, after the rough lapping operation, the stripe and throat height of a magnetic head is approximately within 50 nm of the final target stripe and throat height of a finished magnetic head, the stress within row bars is released using high temperature annealing. However, using high temperature annealing on row bars of magnetic heads, after rough lapping, requires the row bars to be de-bonded from a lapping row tool because high temperature annealing can destroy the adhesive and mounted wire bond board.

UIT provides an alternative to high temperature annealing which does not require row bars to be de-bonded from the lapping row tool. In accordance with embodiments, UIT is used to relieve stresses in the surface and sub-surface of row bars immediately after rough a lapping process. Using UIT to relieve stress solves the problem of having to de-bond row bars post rough lapping to perform high temperature annealing. Although high temperature annealing after rough lapping has conventionally been used to relieve stress because it has historically been the most effective for head stability, extra process steps are needed, which increases the cost of post rough lap annealing. These extra process steps and higher costs are avoided when UIT is used to release stress. Using UIT to relieve stress in row bars increases the stability and performance of finished magnetic heads, as described with reference to FIGS. 7A-7C below, which is an unexpected result.

UIT is a processing technique that utilizes ultrasound to enhance the mechanical and physical properties of metals by applying ultrasonic energy to metal objects. UIT processing can be used to control residual compressive stress, grain refinement and grain size. UIT can also be used to reduce low and high cycle fatigue and address stress corrosion cracking, corrosion fatigue, as well as other metallurgic issues. UIT equipment used to process semiconductor wafers is described in detail with reference to FIG. 5. The frequency that UIT imparts energy on the work pieces can vary between 25 KHz and 250 KHz and have displacement amplitudes of the resonant body ranging between 22 μm and 100 μm.

UIT can also be integrated into the post rough lap cleaning processes, accomplishing the dual purposes of (1) cleaning the row bars to remove slurry and lapping debris, and (2) inducing stresses in head materials that cause "POPPING," which thereby eliminates the need to de-bond and then re-bond/re-wire the row bar to a tool for subsequent lapping operations. According to embodiments, ultrasonic (similar to UIT) technology is integrated into post rough lap cleaning process. When row bars are cleaned and subjected to the ultrasonic technology, which is similar to UIT, the write device and/or surrounding shield materials undergo "POPPING." This "POPPING" of the write device relieves residual stress by allowing the device to protrude from the surface, where it is lapped off at the subsequent final lapping operation, preventing an accidental "POP" after the final lapping, which would likely lead to reliability failure. As explained with reference to FIGS. 7A-7C, data from samples shows a distinct difference in pole tip recession (PTR) profiles and sigma improvement.

Figure 2:
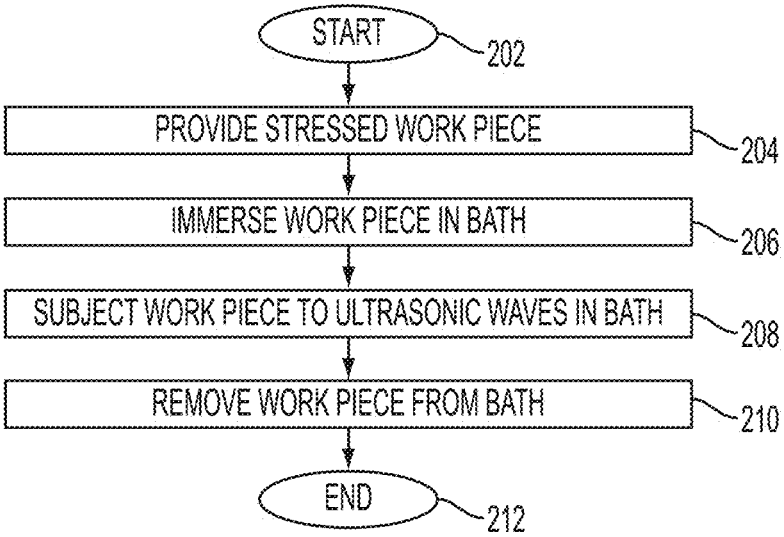
FIG. 2 is a flowchart illustrating a method of reducing stress in a work piece provided using ultrasonic impact technology (UIT).

FIG. 2 is a flowchart illustrating an embodiment of a method used to reduce stress in a work piece using UIT. The process starts in operation 202 when process equipment, including UIT equipment, as well as cleaning equipment, are initialized. In operation 204, a stressed work piece is provided. The work piece can be stressed because of previous manufacturing processes or because it has been subjected to wear and tear such as the application of different cycles, corrosive materials, high or low temperatures, etc. The work piece can also be a work piece with a stressed layer. In one embodiment, the work piece with a stressed layer is a partially fabricated semiconductor device with a stressed layer that is formed on a substrate. In another embodiment, the work piece with a stressed layer is a semiconductor device with a stressed layer fabricated on a substrate. In another embodiment, the work piece with a stressed layer is a partially fabricated microelectromechanical (MEM) system with a stressed layer. In another embodiment, the work piece with a stressed layer is a fabricated microelectromechanical (MEM) system with a stressed layer. In another embodiment, the work piece with a stressed layer is a row bar attached to a substrate, where the row bar has a stressed layer.

As used herein a stressed layer is used generally and can include a stressed layer on the surface of a work piece, a stressed sub-layer within a work piece, combinations of stressed layers on the surface of a work piece and/or stressed sub-layers within a work piece, or combinations of multiple stressed layers on the surface of a workpiece and/or multiple stressed sub-layers within a work piece.

Next in operation 206, the stressed work piece is immersed in a bath. The bath can be any liquid and can contain solvents. For example the liquid can be water and the solvents can include polar solvents (N-methylpyrrolidone (NMP), dimethyl sulfoxide (DMSO), dimethylacetamide (DMAc), dimethylformamide (DMF), tetrahydrofuran (THF), and acetone), alcohol (isopropanol (IPA), ethanol, and propanol, diethylene glycol), or etc. In one embodiment, the solvent is NMP. The work piece is immersed into the bath so that the portion of the work piece that is stressed is completely submersed in the liquid bath.

In operation 208, the stressed work piece is subjected to ultrasonic waves generated in the bath. Energy produced by a power source outputting energy at ultrasonic frequencies is delivered to the stressed work piece through the liquid bath. In some embodiments, the ultrasonic energy applied to the stressed work piece has a similar effect as work hardening the work piece. When the ultrasonic energy impacts the stressed regions of the work piece, the stress is released by the ultrasonic energy.

In one embodiment a 60 liter tank containing NMP solvent at a temperature of 25° C. is used. The ultrasonic waves are produced using two generators. The first generator supplies a first power ranging from 850 watts to 950 watts at a first frequency ranging from 55 KHz to 65 KHz and the second generator supplies a second power ranging from 850 watts to 950 watts at a second frequency ranging from 125 KHz to 135 KHz. In one example embodiment, the first generator operates at a first frequency of approximately 58 KHz and a first power of approximately 900 watts, which provides a first power density of approximately 15 watts/liter. The second generator operates at a second frequency of approximately 132 KHz and a second power of approximately 900 watts, which provides a second power density of approximately 15 watts/liter. In this exemplary embodiment, the work piece is subjected to a total dual frequency of approximately 58 KHz and 132 KHz and a total power of approximately 1800 watts, which provides a total power density of approximately 30 watts/liter. In this exemplary embodiment, the work piece is immersed in the NMP solvent bath and subjected to ultrasonic energy for approximately 25 minutes.

In operation 210, the work piece is removed from the bath. The work piece can be removed from the bath by lifting the work piece from the bath. The process ends in operation 212 when the work piece, which has been processed with UIT, is cleaned with de-ionized (DI) water and dried with hot air.

Figure 3:
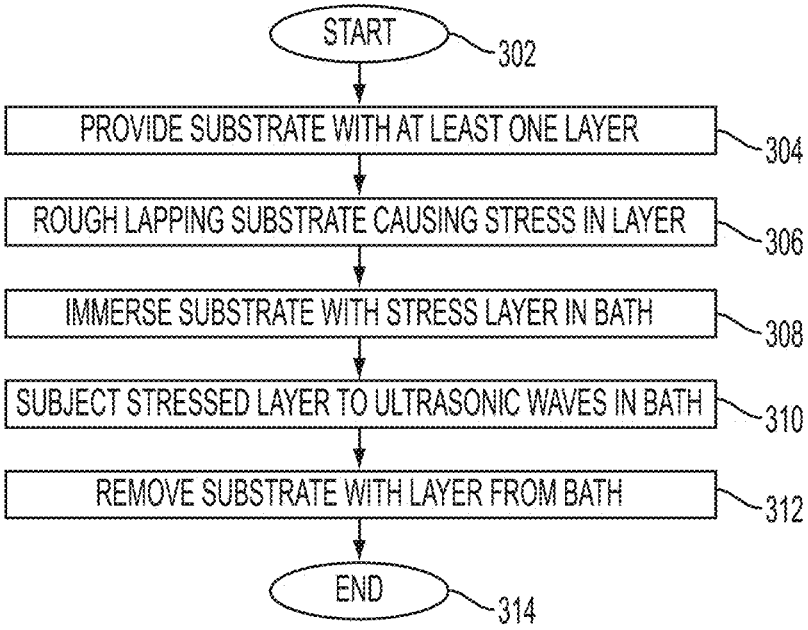
FIG. 3 is a flowchart illustrating fabrication processes that causes stress on a work piece and then releases the stress on the work piece using UIT.

FIG. 3 is a flowchart illustrating an embodiment of fabrication processes that cause stress on a work piece and then release the stress on the work piece using UIT. The process starts in operation 302 when process equipment, including UIT equipment, as well as cleaning equipment, are initialized. In operation 304, a substrate with at least one layer is provided. The substrate with at least one layer can include a partially or completely fabricated semiconductor device with at least one layer that is formed on a substrate, a partially or completely fabricated micro electromechanical (MEM) system with at least one layer formed therein, or at least one row bar that has at least one layer formed on a substrate. The row bars are used to make magnetic heads used in hard drives.

In operation 306, the substrate with at least one layer is subjected to a manufacturing process that causes the layer to become stressed and therefore unstable. If the substrate with at least one layer is a row bar attached to a substrate, then the manufacturing process can be lapping the row bar. The lapping process can induce stress on the row bar because lapping is a mechanical process that alters and removes materials as well as polishes the row bars causing stress to build up on the surface layers and sub-surface of the row bar. Other ways that a substrate with a layer can be stressed is by subjecting the substrate and layer to high or low temperatures or by forming layers of different materials and/or crystal structures over each other.

Next in operation 308, the substrate with stressed layer is immersed in a bath. The bath can be any liquid and can contain solvents. For example the liquid can be water and the solvents can include polar solvents (N-methylpyrrolidone (NMP), dimethyl sulfoxide (DMSO), dimethylacetamide (DMAc), dimethylformamide (DMF), tetrahydrofuran (THF), and acetone), alcohol (isopropanol (IPA), ethanol, and propanol, diethylene glycol), or etc. In one embodiment, the solvent is NMP. The substrate with stressed layer is immersed into the bath so that the stressed layer is completely submersed in the liquid bath. In operation 310, the substrate with stressed layer is subjected to ultrasonic waves generated in the bath. Energy produced by a power source outputting energy at ultrasonic frequencies is delivered to the stressed layer through the liquid bath. When the ultrasonic energy impacts the stressed layer, the stress is released by the ultrasonic energy.

In one embodiment a 60 liter tank containing NMP solvent at a temperature of 25° C. is used. The ultrasonic waves are produced using two generators. The first generator supplies a first power ranging from 850 watts to 950 watts at a first frequency ranging from 55 KHz to 65 KHz and the second generator supplies a second power ranging from 850 watts to 950 watts at a second frequency ranging from 125 KHz to 135 KHz. In one example embodiment, the first generator operates at a first frequency of approximately 58 KHz and a first power of approximately 900 watts, which provides a first power density of approximately 15 watts/liter. The second generator operates at a second frequency of approximately 132 KHz and a second power of approximately 900 watts, which provides a second power density of approximately 15 watts/liter. In this exemplary embodiment, the stressed layer is subjected to a total dual frequency of approximately 58 KHz and 132 KHz and a total power of approximately 1800 watts, which provides a total power density of approximately 30 watts/liter. In this exemplary embodiment, the stressed layer is immersed in the NMP solvent bath and subjected to ultrasonic energy for approximately 25 minutes.

In operation 312, the substrate and layer, which has had its stress released, is removed from the bath. The substrate and layer can be removed from the bath by lifting the substrate and layer from the bath. The process ends in operation 314 when the substrate and layer, which has been processed with UIT, is cleaned with DI water and dried with hot air.

Figure 4:
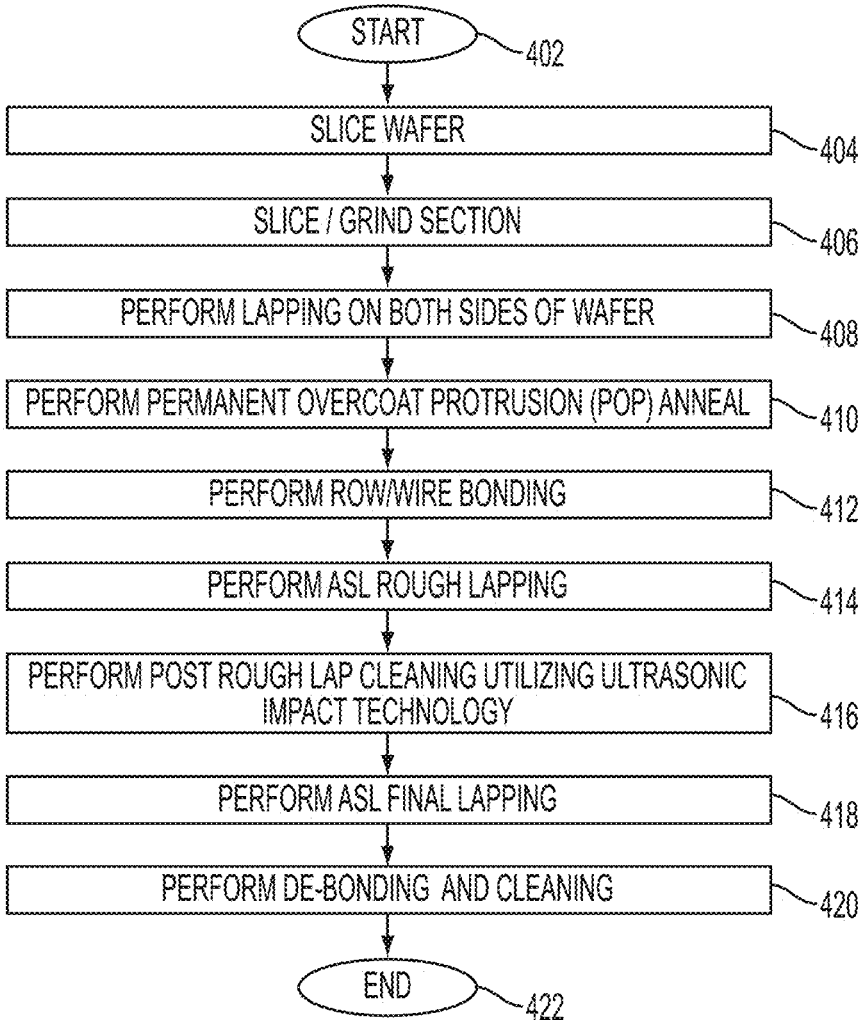
FIG. 4 is a flowchart illustrating fabrication processes that causes stress on a magnetic recording head transducer and then releases the stress on the magnetic recording head transducer using UIT.

FIG. 4 is a flowchart illustrating fabrication processes that cause stress on a magnetic recording head transducer and then release the stress on the magnetic recording head transducer using UIT. The process starts in operation 402 when process equipment, including slicing/dicing equipment, UIT equipment, cleaning equipment, etc. is initialized. In operation 404, a wafer having a series of partially fabricated magnetic heads is sliced into section. Next in operation 406, further slicing and grinding is performed on the sliced sections to produce row bars. In operation 408, frontside lapping and backside lapping are performed on the row bars. The lapping process, as well as the slicing and grinding processes, can induce stress on the row bars because these processes are mechanical processes that manipulate the surfaces and sub-surfaces of the row bars. For example, the lapping process alters and removes materials as well as polishes both sides of the row bar causing stress to build up on the surface layers and sub-layers of both sides of the row bar.

Next in operation 410, permanent overcoat protrusion (POP) annealing is performed on the row bars that were lapped on the frontside and backside. The POP annealing operation can be performed by heating the row bars to temperatures of about 200° C. for about four hours. The POP annealing operation induces "POPPING" of the row bars, which can remove some of the instability currently in the magnetic head. The instability is a result of stresses on the row bars. In operation 412, row/wire bonding is performed on the annealed row bars. Next in operation 414, ASL rough lapping is performed on the row bars that were previously row/wire bonded.

In operation 416, the row bars are cleaned utilizing UIT. The cleaning/UIT operation, which is performed post rough lapping on the row bars, removes any excess materials left over from the lapping processes and releases stress built up on the row bars. In operation 416, the row bars are immersed into a liquid bath containing solvents. The liquid can be water and the solvents can include polar solvents (N-methylpyrrolidone (NMP), dimethyl sulfoxide (DMSO), dimethylacetamide (DMAc), dimethylformamide (DMF), tetrahydrofuran (THF), and acetone), alcohol (isopropanol (IPA), ethanol, and propanol, diethylene glycol), or etc. In one embodiment, the solvent is NMP. The row bars, which can have stressed layers, are immersed into the bath so that the stressed layers are completely submersed in the liquid bath. The row bars, including the stressed layers, are subjected to ultrasonic waves generated in the bath. Energy produced by a power source outputting energy at ultrasonic frequencies is delivered to the row bars, and the stressed layers, through the liquid bath. When the ultrasonic energy impacts the stressed layers, the stress is released by the ultrasonic energy.

In one embodiment a 60 liter tank containing NMP solvent at a temperature of 25° C. is used. The ultrasonic waves are produced using two generators. The first generator supplies a first power ranging from 850 watts to 950 watts at a first frequency ranging from 55 KHz to 65 KHz and the second generator supplies a second power ranging from 850 watts to 950 watts at a second frequency ranging from 125 KHz to 135 KHz. In one example embodiment, the first generator operates at a first frequency of approximately 58 KHz and a first power of approximately 900 watts, which provides a first power density of approximately 15 watts/liter. The second generator operates at a second frequency of approximately 132 KHz and a second power of approximately 900 watts, which provides a second power density of approximately 15 watts/liter. In this example embodiment, the stressed layer is subjected to a total dual frequency of approximately 58 KHz and 132 KHz and a total power of approximately 1800 watts, which provides a total power density of approximately 30 watts/liter. In this exemplary embodiment, the row bars, including any stressed layers, are immersed in the NMP solvent bath and subjected to ultrasonic energy for approximately 25 minutes. The row bars are then removed from the bath by lifting the row bars from the bath. The row bars can be further cleaned with DI water and dried with hot air.

Next in operation 418, final ASL rough lapping is performed on the row bars, which have been previously row/wire bonded, cleaned, and have been stressed relieved with the use of UIT. In operation 420, the row bars are de-bonded and cleaned. The process ends in operation 422 when the row bars are sent on for further processing.

Figure 5:
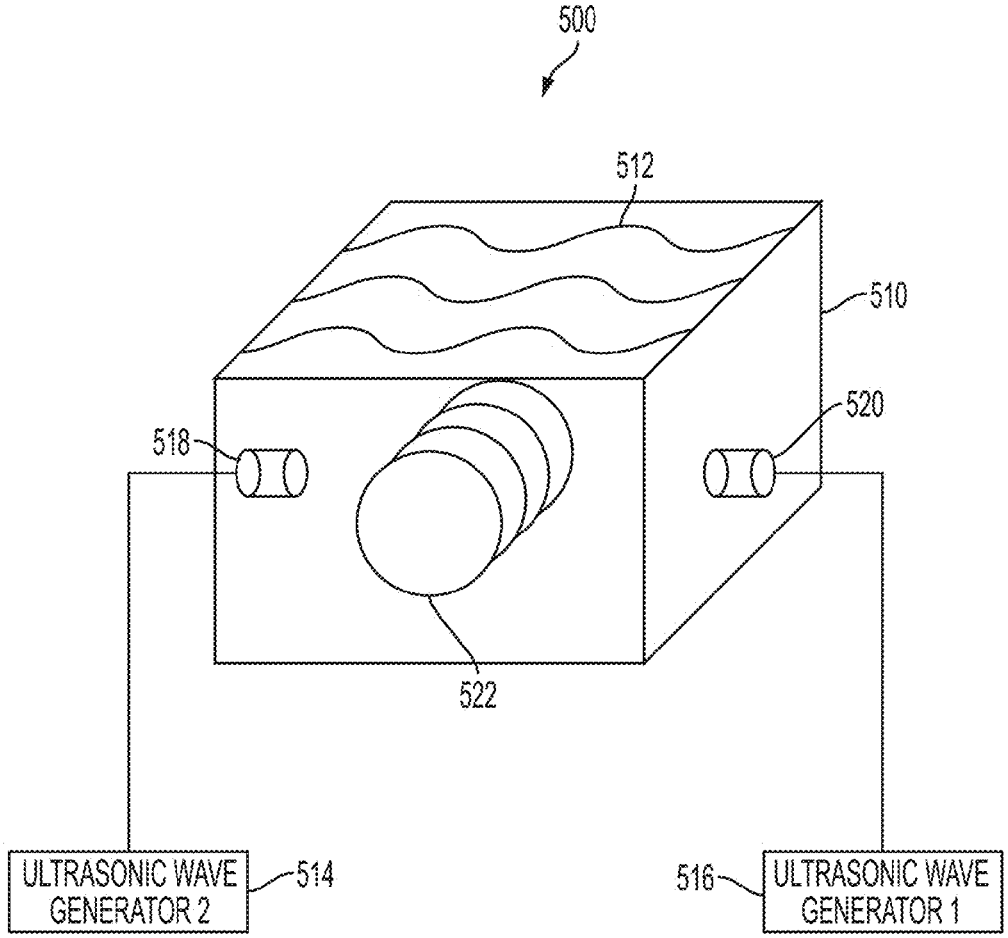
FIG. 5 is an illustration showing a UIT apparatus used to release stress on a work piece using UIT.

FIG. 5 is an illustration showing a UIT apparatus 500 used to release stress on a work piece using UIT. UIT apparatus 500 includes a tank 510, a liquid bath 512, a first ultrasonic wave generator 514, a second ultrasonic wave generator 516, a first ultrasonic transducer 518, a second ultrasonic transducer 520, and work pieces 522. During operation, tank 510 is filled with liquid bath 512 and work pieces 522 are lowered into the bath using a lifting mechanism, which is not shown. First ultrasonic wave generator 514 and second ultrasonic wave generator 516 are then engaged and supply power to first transducer 518 and second transducer 520, respectively. First transducer 518 and second transducer 520 then cause energy to be transmitted to the liquid bath 512, at the frequency and energy supplied by first ultrasonic wave generator 514 and second ultrasonic wave generator 516. Liquid bath 512 then transmits the energy to work pieces 522 which both cleans the work pieces 522 and releases stress built up in the work pieces 522 by UIT.

UIT converts harmonic resonations of liquid bath 512, which can be acoustically tuned, into mechanical impulses that are imparted onto the surfaces of work pieces 522 being treated. The harmonic resonations of liquid bath 512 are energized by ultrasonic transducers (518 and 520). In the conversion process, the energizing first and second ultrasonic transducer (518 and 520) have a frequency determined by first and second ultrasonic wave generator (514 and 516), respectively.

In one embodiment, tank 510 is a 60 liter tank containing 60 liters of liquid bath 512. Liquid bath 512 can be made of water and solvents. The solvents can include polar solvents (N-methylpyrrolidone (NMP), dimethyl sulfoxide (DMSO), dimethylacetamide (DMAc), dimethylformamide (DMF), tetrahydrofuran (THF), and acetone), alcohol (isopropanol (IPA), ethanol, and propanol, diethylene glycol), or etc. In one embodiment, the solvent is NMP and the liquid bath 512 is maintained at a temperature of 25° C.

The ultrasonic waves are produced using two generators. First ultrasonic wave generator 514 supplies a first power ranging from 850 watts to 950 watts at a first frequency ranging from 55 KHz to 65 KHz and second ultrasonic wave generator 516 supplies a second power ranging from 850 watts to 950 watts at a second frequency ranging from 125 KHz to 135 KHz. In one exemplary embodiment, first ultrasonic wave generator 514 operates at a first frequency of approximately 58 KHz and a first power of approximately 900 watts, which provides a first power density of approximately 15 watts/liter. Second ultrasonic wave generator 516 operates at a second frequency of approximately 132 KHz and a second power of approximately 900 watts, which provides a second power density of approximately 15 watts/liter.

First transducer 518 and second transducer 520 can be piezoelectric transducers or magnetostrictive transducers. The choice of which transducer is used depends on several factors including the frequencies at which cleaning and stress release using UIT is chosen, and electrical efficiency of the system. Piezoelectric transducers are made of lead zirconate titanate or other piezoelectric material that expands and contracts when provided with the appropriate electrical frequency and voltage. Magnetostrictive transducers are electromagnets made of a heavy nickel or alloy core which is wound with wire. As electrical current is pulsed through the wires, the core vibrates at a frequency which matches the output frequency of the ultrasonic generator.

In an exemplary embodiment, the stressed layer is subjected to a total dual frequency of approximately 58 KHz and 132 KHz and a total power of approximately 1800 watts, which provides a total power density of approximately 30 watts/liter. In this exemplary embodiment, the work pieces 522, including any stressed layers, are immersed in the NMP solvent liquid bath 512 and subjected to ultrasonic energy for approximately 25 minutes. The work pieces 522 are then removed from the liquid bath 512 by lifting the work pieces 522 from the liquid bath 512. The work pieces 522 can be further cleaned with DI water and dried with hot air.

Figure 6A:
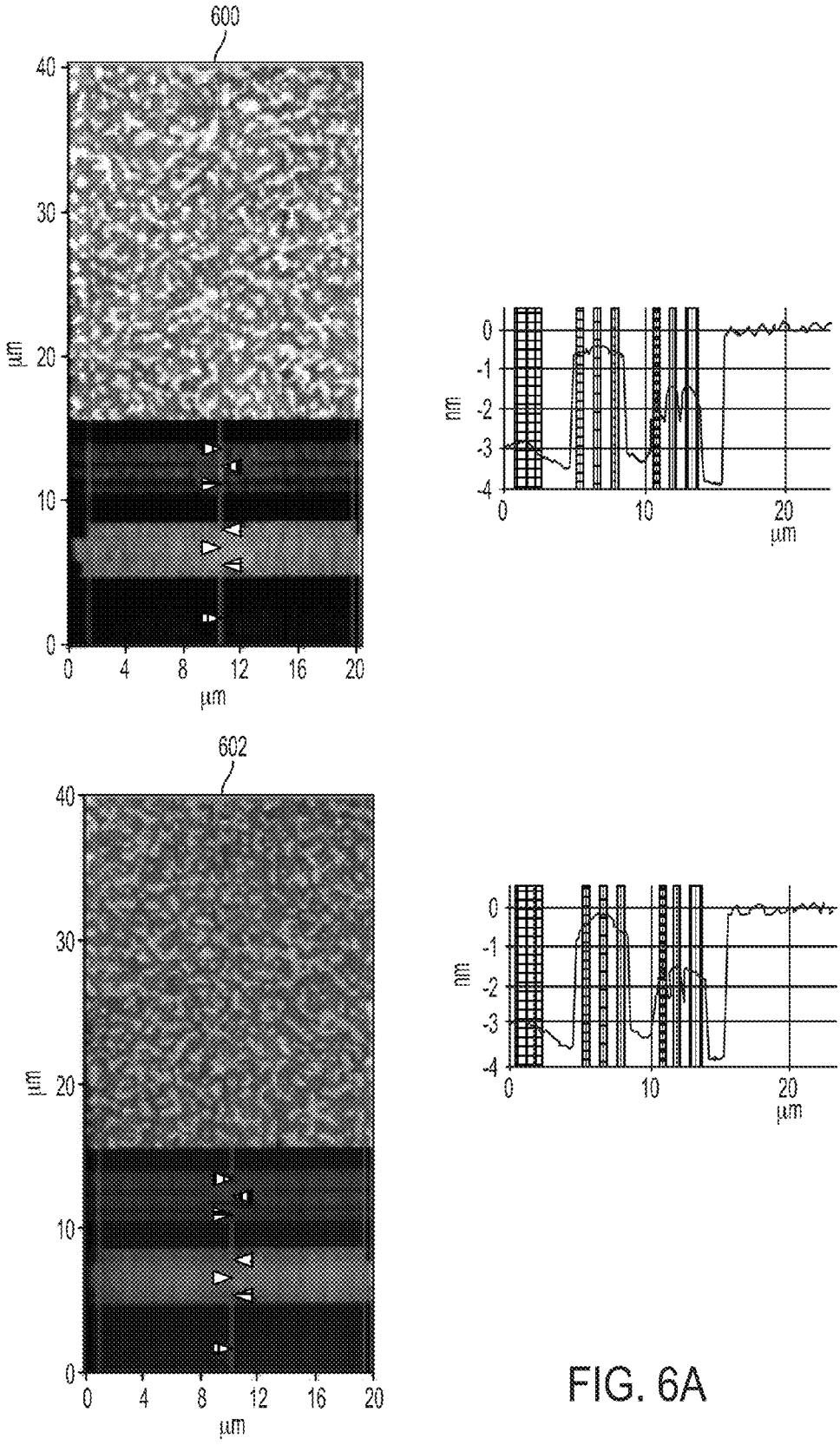
FIG. 6A shows two Atomic Force Microscopy (AFM) profiles of two samples before their stress are released using UIT.
Figure 6B:
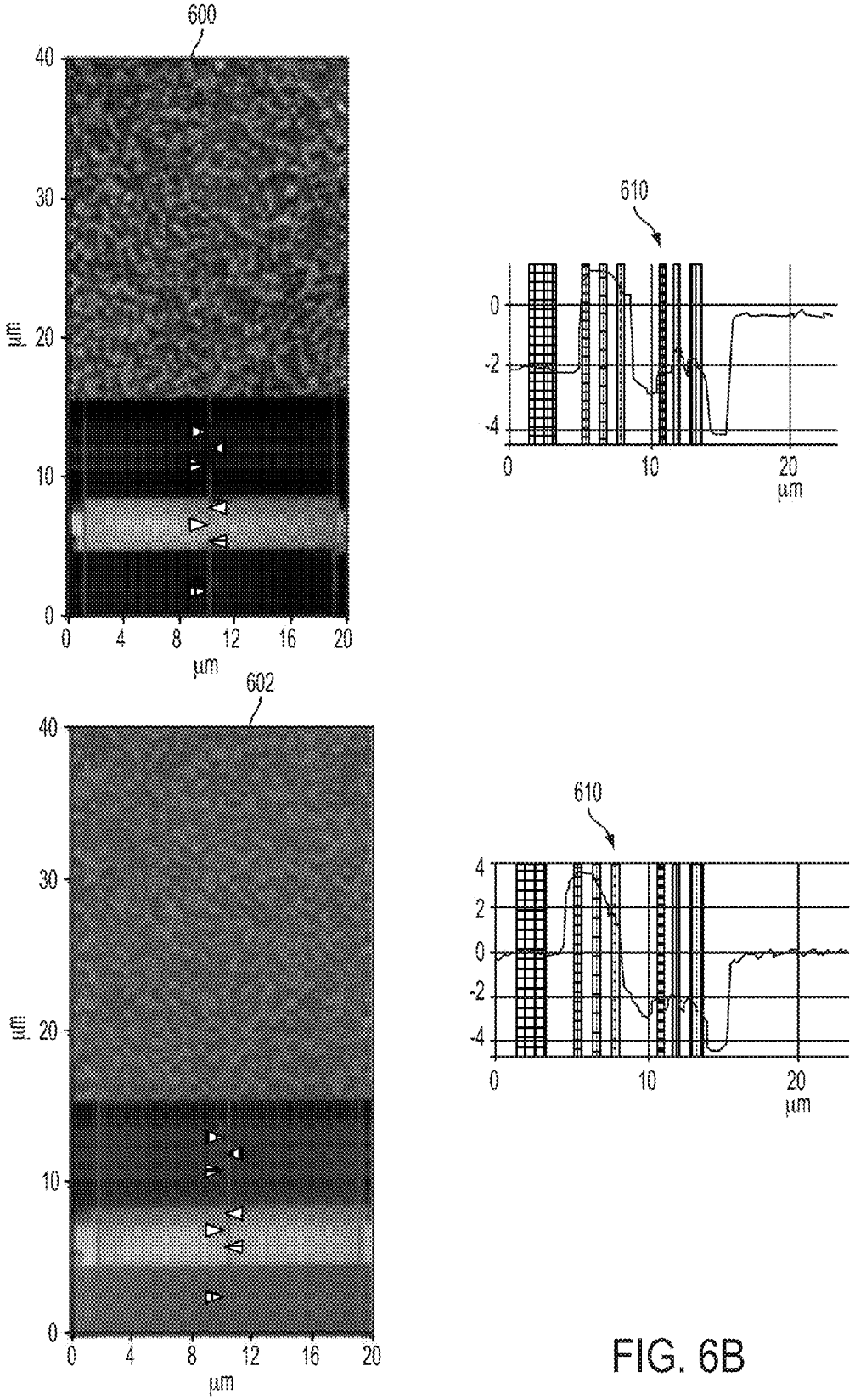
FIG. 6B shows two AFM profiles of samples 600 and 602 shown in FIG. 6A after their stress is released using UIT.

FIGS. 6A and 6B show two AFM profiles of two samples before and after their stresses are released using UIT, respectively. In FIG. 6A, the AFM images of samples 600 and 602 are shown to have surface topographies before UIT is applied. In FIG. 6B, the AFM images of samples 600 and 602 are shown to have surface topographies after UIT is applied. A comparison of the AFM images, which are shown in FIGS. 6A and 6B, depicts that the surface topographies of samples 600 and 602 before being processed with UIT are different than the surface topographies after samples 600 and 602 have been processed with UIT. A comparison of the profile data plotted in FIGS. 6A and 6B shows that samples 600 and 602 have undergone "POPPING" after being subjected to UIT. The profile data plotted in the graphs shown in FIG. 6B, and identified as graphs 610, shows that the write and over coat have undergone "POPPING." The unexpected results that UIT causes "POPPING" significantly simplifies previous complicated processes which included de-bonding row bars, annealing the row bars at high temperatures to release stress, and then re-bonding/re-wiring the row bars after high temperature annealing.

Figure 7A:
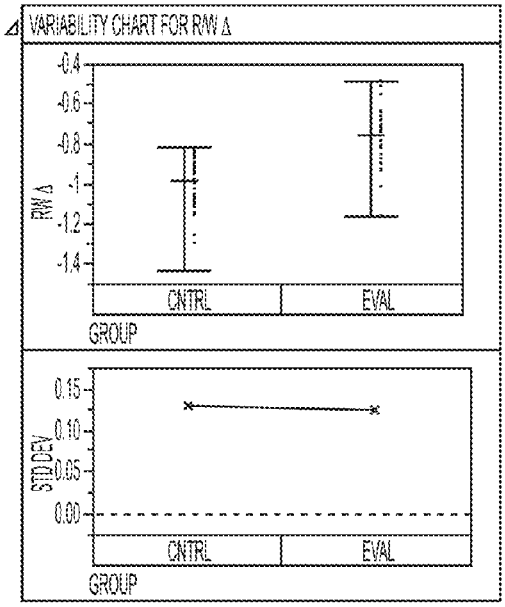
FIG. 7A shows a variability chart comparing Read/Write Delta data of a control group with Read/Write Delta data of an evaluation group, where stress on the magnetic recording head transducer of the evaluation group has been released using UIT.

FIG. 7A shows a variability chart comparing Read/Write Delta data of a control group with Read/Write Delta data of an evaluation group. The evaluation group is different than the control group because the evaluation group consists of magnetic recording head transducers that have been stressed relieved using UIT. The Read/Write delta data shows a significant mean shift and slightly lower sigma for the evaluation group that has been subjected to UIT as compared to the control group, which has not been subjected to UIT. The significant mean shift and slightly lower sigma indicates that stresses are not pushing the writer up creating a smaller delta in the evaluation group that has been treated with UIT.

Figure 7B:
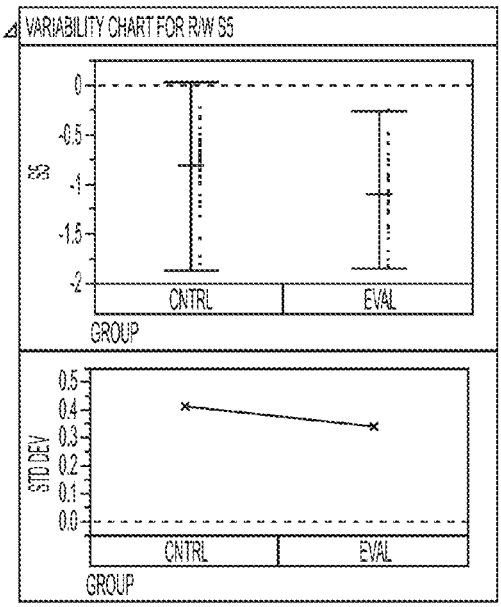
FIG. 7B shows a variability chart comparing S5 of a control group with S5 of an evaluation group, where stress on the magnetic recording head transducer of the evaluation group has been released using UIT.

FIG. 7B shows a variability chart comparing S5 of a control group with S5 of an evaluation group. The evaluation group is different than the control group because the evaluation group consists of magnetic recording head transducers that have been stressed relieved using UIT. The S5 shows significant mean and sigma reduction for the evaluation group that has been subjected to UIT as compared to the control group, which has not been subjected to UIT. The significant mean and sigma reduction indicates stresses are not influencing the PTR profile in the evaluation group that has been treated with UIT.

Figure 7C:
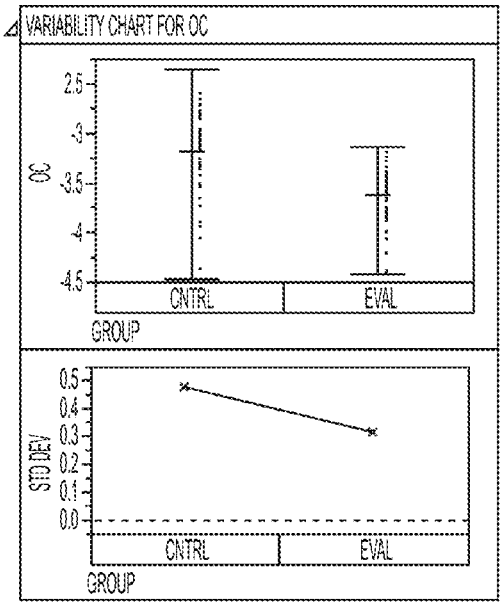
FIG. 7C shows a variability chart comparing the overcoat of a control group with the overcoat of an evaluation group, where stress on the magnetic recording head transducer of the evaluation group has been released using UIT.

FIG. 7C shows a variability chart comparing the overcoat of a control group with the overcoat of an evaluation group. The evaluation group is different than the control group because the evaluation group consists of magnetic recording head transducers that have been stressed relieved using UIT. The overcoat shows significant mean and sigma difference for the evaluation group that has been subjected to UIT as compared to the control group, which has not been subjected to UIT. The significant mean and sigma difference indicates stresses are not influencing the PTR profile in the evaluation group that has been treated with UIT.

The various aspects of this disclosure are provided to enable one of ordinary skill in the art to practice the present invention. Various modifications to exemplary embodiments presented throughout this disclosure will be readily apparent to those skilled in the art, and the concepts disclosed herein may be extended to other devices. Thus, the claims are not intended to be limited to the various aspects of this disclosure, but are to be accorded the full scope consistent with the language of the claims. All structural and functional equivalents to the various components of the exemplary embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A method comprising:

providing a work piece comprising row bars attached to a substrate, the row bars having a stressed layer; and releasing stress built up in the stressed layer by immersing the work piece with the stressed layer into a bath of liquid and subjecting the work piece and the stressed layer to ultrasonic waves generated in the liquid.

2. A method comprising:

providing a partially fabricated microelectromechanical system with a stressed layer; and releasing stress built up in the stressed layer by immersing the partially fabricated microelectromechanical system with the stressed layer into a bath of liquid and subjecting the partially fabricated microelectromechanical system and the stressed layer to ultrasonic waves generated in the liquid.

3. A method comprising:

providing a microelectromechanical system with a stressed layer; and releasing stress built up in the stressed layer by immersing the microelectromechanical system with a stressed layer into a bath of liquid and subjecting the microelectromechanical system the stressed layer to ultrasonic waves generated in the liquid.

4. The method of claim 1 wherein the bath of liquid comprises N-methylpyrrolidone.

5. The method of claim 1 wherein subjecting the work piece and stressed layer to ultrasonic waves comprises applying power to the bath of liquid at two frequencies using a first generator and a second generator.

6. The method of claim 5 wherein:

the first generator supplies a first power ranging from 850 watts to 950 watts at a first frequency ranging from 55 KHz to 65 KHz; and the second generator supplies a second power ranging from 850 watts to 950 watts at a second frequency ranging from 125 KHz to 135 KHz.

7. A method comprising:

providing a substrate with at least one layer, the substrate comprising row bars that have been sliced from a wafer and have a built up stress;

rough lapping the substrate with the at least one layer, wherein the lapped substrate comprises at least one stressed layer; and treating the substrate and the stressed layer with ultrasonic waves to release stress built up after the substrate and the at least one layer have undergone rough lapping.

8. The method of claim 7 wherein treating the substrate and the stressed layer with ultrasonic waves is integrated with a rough lap cleaning process.

9. The method of claim 7 wherein treating the substrate and the stressed layer with ultrasonic waves results in an over coat protrusion at a shield material formed in the layer.

10. The method of claim 7 further comprising final lapping the substrate and the at least one layer treated with ultrasonic waves to remove an over coat protrusion from the surface of the at least one layer.

11. The method of claim 10 further comprising annealing the substrate and the at least one layer after the substrate and the at least one layer have undergone final lapping without causing an additional over coat protrusion in the substrate and the at least one layer.

12. The method of claim 7 wherein providing the substrate with the at least one layer further comprises:

cutting the row bars from the wafer using a saw;

attaching the cut row bars to the substrate; and providing the substrate with the attached row bars.

13. The method of claim 7 wherein treating the substrate and the stressed layer with ultrasonic waves comprises:

immersing the substrate with the stressed layer into a bath of liquid; and subjecting the substrate and the stressed layer to ultrasonic waves generated in the liquid.

14. The method of claim 7 wherein treating the substrate and the stressed layer with ultrasonic waves comprises applying power to a bath of liquid at two frequencies using a first generator and a second generator.

15. The method of claim 14 wherein:

the first generator supplies a first power ranging from 850 watts to 950 watts at a first frequency ranging from 55 KHz to 65 KHz; and the second generator supplies a second power ranging from 850 watts to 950 watts at a second frequency ranging from 125 KHz to 135 KHz.

* * * * *